US008318643B2

(12) United States Patent
Van Houten

(10) Patent No.: US 8,318,643 B2
(45) Date of Patent: Nov. 27, 2012

(54) TRUNK PISTON ENGINE LUBRICATING OIL COMPOSITIONS

(75) Inventor: Wilhelmus Petrus Antonie Van Houten, Prinsenbeek (NL)

(73) Assignee: Cherron Oronite Technology B.V., Rotterdam (NL)

( * ) Notice: Subject to any disclaimer, the term of this patent is extended or adjusted under 35 U.S.C. 154(b) by 19 days.

(21) Appl. No.: 12/803,491

(22) Filed: Jun. 29, 2010

(65) Prior Publication Data

US 2011/0319304 A1 Dec. 29, 2011

(51) Int. Cl.
*C10M 101/00* (2006.01)
*C10M 169/04* (2006.01)

(52) U.S. Cl. ..... 508/110; 508/459

(58) Field of Classification Search ..... 508/459, 508/110

See application file for complete search history.

(56) References Cited

U.S. PATENT DOCUMENTS

| | | | | |
|---|---|---|---|---|
| 3,036,003 | A | 5/1962 | Dolton | |
| 3,172,892 | A | 3/1965 | Le Suer et al. | |
| 3,219,666 | A | 11/1965 | Norman et al. | |
| 3,272,746 | A | 9/1966 | Greenwald | |
| 3,275,554 | A | 9/1966 | Wagenaar | |
| 3,329,658 | A | 7/1967 | Fields | |
| 3,438,757 | A | 4/1969 | Honnen et al. | |
| 3,449,250 | A | 6/1969 | Fields | |
| 3,454,555 | A | 7/1969 | Vandervoort et al. | |
| 3,565,804 | A | 2/1971 | Honnen et al. | |
| 3,586,629 | A | 6/1971 | Otto et al. | |
| 3,591,598 | A | 7/1971 | Traise et al. | |
| 3,666,730 | A | 5/1972 | Coleman | |
| 3,980,569 | A | 9/1976 | Pindar et al. | |
| 4,234,435 | A | 11/1980 | Meinhardt et al. | |
| 4,513,155 | A | 4/1985 | Tamura et al. | |
| 4,604,491 | A | 8/1986 | Dressler et al. | |
| 4,612,132 | A | 9/1986 | Wollenberg et al. | |
| 4,746,446 | A | 5/1988 | Wollenberg et al. | |
| 4,764,794 | A | 8/1988 | Fujii | |
| 5,135,638 | A | 8/1992 | Miller | |
| 5,236,610 | A * | 8/1993 | Perez et al. | 508/440 |
| 5,282,958 | A | 2/1994 | Santilli et al. | |
| 5,716,912 | A | 2/1998 | Harrison et al. | |
| 6,165,235 | A | 12/2000 | Kolp et al. | |
| 6,372,696 | B1 | 4/2002 | Tipton | |
| 6,440,905 | B1 | 8/2002 | Epps et al. | |
| 6,462,001 | B1 | 10/2002 | Kenbeek et al. | |
| 6,503,956 | B2 | 1/2003 | Maleksaden | |
| 2004/0009881 | A1 * | 1/2004 | Hessell et al. | 508/110 |
| 2005/0133409 | A1 | 6/2005 | Abernathy et al. | |
| 2008/0039349 | A1 * | 2/2008 | Dodd et al. | 508/460 |
| 2009/0093387 | A1 | 4/2009 | Bertram et al. | |
| 2009/0281009 | A1 | 11/2009 | Van Houten | |
| 2009/0291869 | A1 * | 11/2009 | Gregory | 508/460 |
| 2009/0291870 | A1 | 11/2009 | Gregory | |
| 2010/0062957 | A1 | 3/2010 | Bertram et al. | |

FOREIGN PATENT DOCUMENTS

| | | |
|---|---|---|
| EP | 1197545 | 4/2002 |
| WO | 2007050451 | 5/2007 |
| WO | 2008/102114 | 8/2008 |

OTHER PUBLICATIONS

Rudnick, Leslier R. "Synthetics, Mineral Oils, and Bio-Based Lubricants, Chemistry and Technology", Taylor & Francis, 7, pp. 139-146 (2006).

International Search Report issued in counterpart European Patent Appln. No. 11170937, Sep. 5, 2011.

* cited by examiner

*Primary Examiner* — Jim Goloboy
(74) *Attorney, Agent, or Firm* — Carlton Virassammy

(57) ABSTRACT

A trunk piston engine lubricating oil composition is disclosed comprising (a) a major amount of a base stock containing at least 90% by weight saturated hydrocarbons; and (b) a base stock selected from the group consisting of (i) an ester base stock wherein the ester base stock is present in an amount greater than 10% by weight and no greater than about 45% by weight, based on the total weight of the lubricating oil composition, (ii) an alkylated aromatic base stock, (iii) a base stock having an aromatic content of at least about 50% by weight wherein the base stock having an aromatic content of at least about 50% by weight is not an aromatic extract, and mixtures thereof.

10 Claims, No Drawings

TRUNK PISTON ENGINE LUBRICATING OIL COMPOSITIONS

BACKGROUND OF THE INVENTION

1. Technical Field

The present invention generally relates to trunk piston engine lubricating oil compositions.

2. Description of the Related Art

Trunk piston engines operate using various types and qualities of diesel fuels and heavy fuel oils. These fuels typically contain high concentrations of asphaltenes, generally the heaviest and most polar fraction of petroleum distillate. Asphaltenes are highly complex compounds believed to be composed of polyaromatic sheets containing alkyl side chains, and are generally insoluble in lubricating oils. When heavy fuel oils and conventional lubricant oil compositions mix in different temperature regions of a trunk piston engine, black sludge (such as asphaltene deposits or other deposits) and other asphaltene derived deposits (such as undercrown deposits) tend to form. The formation of black sludge or deposit can adversely affect the service interval and maintenance cost of the trunk piston engine.

Presently, there is a move in the industry in different regions of the world to replace Group I base oils with Group II base oils in trunk engine oils. Group II base oils generally have a lower aromatic content than Group I base oils, thereby resulting in a loss of heavy fuel oil (also known as residual fuel oil) compatibility when Group II or higher base oils are used in trunk piston engine lubricating oils rather than Group I base oils. It is believed that this loss of heavy fuel oil compatibility is due to the much lower solubility of asphaltenes in the Group II or higher base oils compared to Group I base oils. Generally, the problem of the loss of heavy fuel oil compatibility has been typically addressed by increasing the amount of detergent-containing trunk piston engine lubricating oil additive packages.

U.S. Patent Application Publication No. 20080039349 ("the '349 application") discloses a lubricating oil composition containing (a) an oil of lubricating viscosity; (b) at least one overbased metal detergent; and (c) at least one substituted diaryl compound. The '349 application further discloses that the lubricating oil composition exhibits improved asphaltene dispersancy in a trunk piston diesel engine.

U.S. Patent Application Publication No. 20090093387 ("the '387 application") discloses a lubricating oil composition containing (a) a Group II basestock, and (b) a neutral or overbased metal hydrocarbyl-substituted hydroxybenzoate detergent having a basicity index of less than 2. The '387 application further discloses that the neutral or overbased metal salicylate detergent having a basicity index of less than 2 improves asphaltene dispersancy in Group II basestocks.

U.S. Patent Application Publication No. 20090281009 ("the '009 application") discloses a lubricating oil composition comprising: (a) a major amount of a Group I base oil and/or a Group II base oil; and (b) at least one detergent comprising a salt of an alkyl-substituted hydroxybenzoic acid, wherein at least 90% of the alkyl groups are $C_{20}$ or greater, wherein the lubricating oil composition is a medium or high soap formulation. The '009 application further discloses that the composition exhibited less black sludge formation, better stability against oxidation-based viscosity increase and improved detergency properties in low sulfur marine residual fuels than lubricating oil compositions containing a conventional salicylate-based detergent.

U.S. Patent Application Publication No. 20090291869 ("the 869 application") discloses a trunk piston marine engine lubricating oil composition comprising (a) a Group II basestock, and, (b) an overbased metal hydrocarbyl-substituted hydroxybenzoate detergent having a basicity index of 5.5 or greater; and (c) an overbased metal hydrocarbyl-substituted hydroxybenzoate detergent having a basicity index of 2 or less, wherein the ratio of the mass of metal in detergent (b) to the mass of metal in detergent (c) is 10 or less; the trunk piston marine engine lubricating oil composition having a TBN (using ASTM D2896) of 20 to 60. The '869 application further discloses that the composition improves asphaltene dispersancy in Group II basestocks.

U.S. Patent Application Publication No. 20090291870 ("the 870 application") discloses a trunk piston marine engine lubricating oil composition comprising (a) a Group II basestock, and, (b) an overbased metal hydrocarbyl-substituted hydroxybenzoate detergent having a basicity index of 5.5 or greater; and (c) an overbased metal hydrocarbyl-substituted hydroxybenzoate detergent having a basicity index in the range of 2.1 to 5.4, wherein the ratio of the mass of metal in detergent (b) to the mass of metal in detergent (c) is 1 or less; the trunk piston marine engine lubricating oil composition having a TBN (using ASTM D2896) of 20 to 60. The '870 application further discloses that the composition improves asphaltene dispersancy in Group II basestocks.

U.S. Patent Application Publication No. 20100062957 discloses a method of reducing asphaltene precipitation (black paint) in an engine, the method including the step of lubricating the engine with a lubricating oil composition comprising, or made by admixing: (a) an oil of lubricating viscosity in a major amount; and (b) a salicylate detergent system in a minor amount comprising one or more neutral or overbased alkaline earth metal $C_{22}$ hydrocarbyl substituted salicylates; with the proviso that the salicylate detergent system does not include an alkali metal salicylate.

WO2008102114 ("the '114 application") discloses a liquid lubricant base oil composition useful for a 2-stroke marine diesel engine cylinder oil, a 2-stroke marine diesel engine system oil, and a 4-stroke marine diesel engine. The lubricant base oil composition disclosed in the '114 application contains (a) a base stock comprising at least 95 wt. % saturated hydrocarbons, and (b) 0.2 to 30 wt. % of an aromatic (brightstock) extract. A bright stock is a high viscosity base oil which has been conventionally produced from residual stocks or bottoms and has been highly refined and dewaxed. The '114 application further discloses that the combination of a Group II base oil and a low polycyclic aromatic brightstock extract demonstrated improved viscosity ratio and improved oxidation and wear performance.

It would be desirable to develop a trunk piston engine lubricating oil composition which exhibits improved heavy fuel compatibility.

SUMMARY OF THE INVENTION

In accordance with one embodiment of the present invention, a trunk piston engine lubricating oil composition is provided comprising (a) a major amount of a base stock containing at least 90% by weight saturated hydrocarbons; and (b) a base stock selected from the group consisting of (i) an ester base stock wherein the ester base stock is present in an amount greater than 10% by weight and no greater than about 45% by weight, based on the total weight of the lubricating oil composition, (ii) an alkylated aromatic base stock, (iii) a base stock having an aromatic content of at least about 50% by weight, wherein the base stock having an aromatic content of at least about 50% by weight is not an aromatic extract, and mixtures thereof.

In accordance with a second embodiment of the present invention, a trunk piston engine lubricating oil composition is provided comprising (a) a major amount of a base stock containing at least 90% by weight saturated hydrocarbons; and (b) a base stock selected from the group consisting of (i) an ester base stock wherein the ester base stock is present in an amount greater than 10% by weight and no greater than about 45% by weight, based on the total weight of the lubricating oil composition, (ii) an alkylated aromatic base stock, (iii) a base stock having an aromatic content of at least about 50% by weight, wherein the base stock having an aromatic content of at least about 50% by weight is not an aromatic extract, and mixtures thereof, wherein base stock (b)(ii) is different than base stock (b)(iii).

In accordance with a third embodiment of the present invention, a trunk piston engine lubricating oil composition is provided comprising (a) a major amount of a base stock containing at least 90% by weight saturated hydrocarbons; and (b) a base stock selected from the group consisting of (i) an ester base stock wherein the ester base stock is present in an amount greater than 10% by weight and no greater than about 45% by weight, based on the total weight of the lubricating oil composition, (ii) an alkylated aromatic base stock, (iii) a base stock having an aromatic content of at least about 50% by weight, wherein the base stock having an aromatic content of at least about 50% by weight is not an aromatic extract, and mixtures thereof, wherein the trunk piston engine lubricating oil composition is substantially free of a Group I base oil.

In accordance with a fourth embodiment of the present invention, there is provided a method for improving heavy fuel oil compatibility of a trunk piston engine lubricating oil composition comprising a major amount of a base stock containing at least 90% by weight saturated hydrocarbons, the method comprising adding to the trunk piston engine lubricating oil composition a base stock selected from the group consisting of (i) an ester base stock wherein the ester base stock is present in an amount greater than 10% by weight and no greater than about 45% by weight, based on the total weight of the lubricating oil composition, (ii) an alkylated aromatic base stock, (iii) a base stock having an aromatic content of at least about 50% by weight, wherein the base stock having an aromatic content of at least about 50% by weight is not an aromatic extract, and mixtures thereof.

In accordance with a fifth embodiment of the present invention, there is provided a method for operating a trunk piston engine comprising lubricating the trunk piston engine with a trunk piston engine lubricating oil composition comprising (a) a major amount of a base stock containing at least 90% by weight saturated hydrocarbons; and (b) a base stock selected from the group consisting of (i) an ester base stock wherein the ester base stock is present in an amount greater than 10% by weight and no greater than about 45% by weight, based on the total weight of the lubricating oil composition, (ii) an alkylated aromatic base stock, (iii) a base stock having an aromatic content of at least about 50% by weight, wherein the base stock having an aromatic content of at least about 50% by weight is not an aromatic extract, and mixtures thereof.

In accordance with a sixth embodiment of the present invention, the use of a base stock selected from the group consisting of (i) an ester base stock wherein the ester base stock is present in an amount greater than 10% by weight and no greater than about 45% by weight, based on the total weight of the lubricating oil composition, (ii) an alkylated aromatic base stock, (iii) a base stock having an aromatic content of at least about 50% by weight, wherein the base stock having an aromatic content of at least about 50% by weight is not an aromatic extract, and mixtures thereof for the purpose of improving heavy fuel oil compatibility of a trunk piston engine lubricating oil composition comprising a major amount of a base stock containing at least 90% by weight saturated hydrocarbons is provided.

The addition of a base stock selected from the group consisting of (i) an ester base stock wherein the ester base stock is present in an amount greater than 10% by weight and no greater than about 45% by weight, based on the total weight of the lubricating oil composition, (ii) an alkylated aromatic base stock, (iii) a base stock having an aromatic content of at least about 50% by weight, wherein the base stock having an aromatic content of at least about 50% by weight is not an aromatic extract, and mixtures thereof to a trunk piston engine lubricating oil composition comprising a major amount of a base stock containing at least 90% by weight saturated hydrocarbons advantageously improves the heavy fuel oil compatibility of the trunk piston engine lubricating oil composition. In addition, the trunk piston engine lubricating oil compositions of the present invention exhibit less black sludge formation than a trunk piston engine lubricating oil composition containing only a base stock containing at least 90% by weight saturated hydrocarbons.

DETAILED DESCRIPTION OF THE PREFERRED EMBODIMENTS

The present invention is directed to a trunk piston engine lubricating oil composition comprising (a) a major amount of a base stock containing at least 90% by weight saturated hydrocarbons; and (b) a base stock selected from the group consisting of (i) an ester base stock wherein the ester base stock is present in an amount greater than 10% by weight and no greater than about 45% by weight, based on the total weight of the lubricating oil composition, (ii) an alkylated aromatic base stock, (iii) a base stock having an aromatic content of at least about 50% by weight, wherein the base stock having an aromatic content of at least about 50% by weight is not an aromatic extract, and mixtures thereof. The base stock containing at least 90% by weight saturated hydrocarbons is present in a major amount, e.g., an amount greater than 50% by weight, based on the total weight of the composition. In one embodiment, the base stock containing at least 90% by weight saturated hydrocarbons is present in an amount of greater than 50% by weight, based on the total weight of the composition. In another embodiment, the base stock containing at least 90% by weight saturated hydrocarbons is present in an amount greater than about 70% by weight, based on the total weight of the composition. In yet another embodiment, the base stock containing at least 90% by weight saturated hydrocarbons is present in an amount of greater than 50% by weight to about 95% by weight, based on the total weight of the composition. In still yet another embodiment, the base stock containing at least 90% by weight saturated hydrocarbons is present in an amount of from about 70% by weight to about 95% by weight, based on the total weight of the composition.

The base stock containing at least 90% by weight saturated hydrocarbons may contain one or more Group II base oils and/or one or more Group III base oils and/or a base stock derived from a Fischer-Tropsch synthesized, waxy, paraffinic hydrocarbon material. A Group II base oil and/or Group III base oil can be any petroleum derived base oil of lubricating viscosity as defined in API Publication 1509, 14th Edition, Addendum I, December 1998. API guidelines define a base stock as a lubricant component that may be manufactured using a variety of different processes.

Group II base oils generally refer to a petroleum derived lubricating base oil having a total sulfur content equal to or less than 300 parts per million (ppm) (as determined by ASTM D 2622, ASTM D 4294, ASTM D 4927 or ASTM D 3120), a saturates content equal to or greater than 90 weight percent (as determined by ASTM D 2007), and a viscosity index (VI) of between 80 and 120 (as determined by ASTM D 2270).

Group III base oils generally have less than 300 ppm sulfur, a saturates content greater than 90 weight percent, and a VI of 120 or greater. In one embodiment, the base stock contains at least about 95% by weight saturated hydrocarbons. In another embodiment, the base stock contains at least about 99% by weight saturated hydrocarbons.

The terms "Fischer-Tropsch derived" or "FT derived" means that the product, fraction, or feed originates from or is produced at some stage by a Fischer-Tropsch process. The feedstock for the Fischer-Tropsch process may come from a wide variety of hydrocarbonaceous resources, including natural gas, coal, shale oil, petroleum, municipal waste, derivatives of these, and mixtures thereof.

Slack wax can be obtained from conventional petroleum derived feedstocks by either hydrocracking or by solvent refining of the lube oil fraction. Typically, slack wax is recovered from solvent dewaxing feedstocks prepared by one of these processes. Hydrocracking is usually preferred because hydrocracking will also reduce the nitrogen content to a low value. With slack wax derived from solvent refined oils, deoiling may be used to reduce the nitrogen content. Hydrotreating of the slack wax can be used to lower the nitrogen and sulfur content. Slack waxes posses a very high viscosity index, normally in the range of from about 140 to 200, depending on the oil content and the starting material from which the slack wax was prepared. Therefore, slack waxes are suitable for the preparation of a Fischer-Tropsch derived base stock having a very high viscosity index.

The waxy feed useful herein generally has less than about 25 ppm total combined nitrogen and sulfur. Nitrogen is measured by melting the waxy feed prior to oxidative combustion and chemiluminescence detection by ASTM D 4629-96. The test method is further described in U.S. Pat. No. 6,503,956, the contents of which are incorporated by reference herein. Sulfur is measured by melting the waxy feed prior to ultraviolet fluorescence by ASTM D 5453-00. The test method is further described in U.S. Pat. No. 6,503,956, the contents of which are incorporated by reference herein.

Waxy feeds useful in this invention are expected to be plentiful and relatively cost competitive in the near future as large-scale Fischer-Tropsch synthesis processes come into production. Syncrude prepared from the Fischer-Tropsch process comprises a mixture of various solid, liquid, and gaseous hydrocarbons. Those Fischer-Tropsch products which boil within the range of lubricating base oil contain a high proportion of wax which makes them ideal candidates for processing into lubricating base oil. Accordingly, Fischer-Tropsch wax represents an excellent feed for preparing high quality lubricating base oils according to the process of the invention. Fischer-Tropsch wax is normally solid at room temperature and, consequently, displays poor low temperature properties, such as pour point and cloud point. However, following hydroisomerization of the wax, Fischer-Tropsch derived lubricating base oils having excellent low temperature properties may be prepared. A general description of suitable hydroisomerization dewaxing processes may be found in U.S. Pat. Nos. 5,135,638 and 5,282,958; and U.S. Patent Application Publication No. 20050133409, the contents of each of which are incorporated by reference herein.

The hydroisomerization is achieved by contacting the waxy feed with a hydroisomerization catalyst in an isomerization zone under hydroisomerizing conditions. The hydroisomerization catalyst preferably comprises a shape selective intermediate pore size molecular sieve, a noble metal hydrogenation component, and a refractory oxide support. The shape selective intermediate pore size molecular sieve is preferably selected from the group consisting of SAPO-11, SAPO-31, SAPO-41, SM-3, ZSM-22, ZSM-23, ZSM-35, ZSM-48, ZSM-57, SSZ-32, offretite, ferrierite, and mixtures thereof SAPO-11, SM-3, SSZ-32, ZSM-23, and mixtures thereof are more preferred. Preferably the noble metal hydrogenation component is platinum, palladium, or mixtures thereof.

The hydroisomerizing conditions depend on the waxy feed used, the hydroisomerization catalyst used, whether or not the catalyst is sulfided, the desired yield, and the desired properties of the lubricating base oil. Preferred hydroisomerizing conditions useful in the current invention include temperatures of 260° C. to about 413° C. (500 to about 775° F.), a total pressure of 15 to 3000 psig, and a hydrogen to feed ratio from about 0.5 to 30 MSCF/bbl, preferably from about 1 to about 10 MSCF/bbl, more preferably from about 4 to about 8 MSCF/bbl. Generally, hydrogen will be separated from the product and recycled to the isomerization zone.

The hydroisomerization conditions are preferably tailored to produce one or more fractions having greater than about 5 weight percent molecules with monocycloparaffinic functionality, and more preferably having greater than about 10 weight percent molecules with monocycloparaffinic functionality. The fractions will preferably have a ratio of molecules with monocycloparaffinic functionality to molecules with multicycloparaffinic functionality greater than about 20. The fractions will typically have a viscosity index greater than an amount calculated by the equation: VI=28×Ln(Kinematic Viscosity at 100° C.)+95 and a pour point less than 0° C. Preferably the pour point will be less than −10° C. "Ln" in the VI equation refers to the natural logarithm to the base 'e'. Viscosity index is determined by ASTM D 2270-93(1998).

In one preferred embodiment, the base stock containing at least 90% by weight saturated hydrocarbons or at least about 95% by weight saturated hydrocarbons or at least about 99% by weight saturated hydrocarbons is one or more Group II base oils.

Base stock (b) of the trunk piston engine lubricating oil composition is a base stock selected from the group consisting of (i) an ester base stock wherein the ester base stock is present in an amount greater than 10% by weight and no greater than about 45% by weight, based on the total weight of the lubricating oil composition, (ii) an alkylated aromatic base stock, and (iii) a base stock having an aromatic content of at least about 50% by weight, wherein the base stock having an aromatic content of at least about 50% by weight is not an aromatic extract, and mixtures thereof.

Suitable organic ester base stocks include, but are not limited to, monoesters, diesters, polyol esters, and the like. The ester basestocks are generally considered Group V base stocks, which is a collection of all base oils that do not fall into the Group I-IV base oil categories. Generally, the organic ester basestocks are derived from animal or vegetable sources. Naturally occurring organic esters are found in animal fats such as sperm oil and lard oil, or in vegetable oils such as rapeseed and castor oil. The organic esters can be synthesized by reacting organic acids with alcohols.

Monoesters are prepared by reacting monohydric alcohols with monobasic fatty acids creating a molecule with a single ester linkage and linear or branched alkyl groups. These products are generally very low in viscosity (usually under 2 cSt at 100° C.) and exhibit extremely low pour points and high VIs.

Diesters are prepared by reacting monohydric alcohols with dibasic acids creating a molecule which may be linear, branched, or aromatic and with two ester groups. The more common diester types are adipates, azelates, sebacates, dodecanedioates, phthalates, and dimerates. In one embodiment, the diesters include, by way of example, di(1-ethylpropyl) adipate, di(3-methylbutyl)adipate, di(1,3-methylbutyl)adipate, di(2-ethylhexyl)adipate, di(isononyl)adipate, di(isodecyl)adipate, di(undecyl)adipate, di(tridecyl)adipate, di(isotetradecyl)adipate, di(2,2,4-trimethylpentyl)adipate, di[mixed (2-ethylhexyl, isononyl)]adipate, di(1-ethylpropyl) azelate, di(3-methylbutyl)azelate, di(2-ethylbutyl)azelate, di(2-ethylhexyl)azelate, di(isooctyl)azelate, di(isononyl)azelate, di(isodecyl)azelate, di(tridecyl)azelate, di[mixed (2-ethylhexyl, isononyl)]azelate, di[mixed (2-ethylhexyl, decyl)azelate, di[mixed (2-ethylhexyl, isodecyl)]azelate, di[mixed (2-ethylhexyl, 2-propylheptyl)]azelate, di(n-butyl)sebacate, di(isobutyl)sebacate, di(1-ethylpropyl)sebacate, di(1,3-methylbutyl)sebacate, di(2-methylbutyl)sebacate, di(2-ethylhexyl)sebacate, di[2-(2-ethylbutoxy)ethyl]sebacate, di(2,2,4-trimethylbenzyl)sebacate, di(isononyl)sebacate, di(isodecyl)sebacate, di(isoundecyl)sebacate, di(tridecyl)sebacate, di(isotetradecyl)sebacate, di[mixed (2-ethylhexyl, isononyl)]sebacate, di(2-ethylhexyl)glutarate, di(isoundecyl)glutarate, and di(isotetradecyl)glutarate.

Polyol esters can be prepared by esterifying one or more polyols with one or more organic acids. See, for example, U.S. Pat. No. 6,462,001, the contents of which are incorporated by reference herein. The synthesis of polyol esters from one or more polyols and one or more organic acids can be performed by methods known in the art, for example, by subjecting them to dehydrating condensation in the presence of an acid catalyst. The polyols for use in forming the polyol esters can be those having from 2 to about 10 carbon atoms and from two to six hydroxyl groups. One example of a polyol for use herein is a neopentyl polyol having 5 to 10 carbon atoms. The term "neopentyl polyol" as used herein means a polyhydric alcohol having a neopentyl group. Examples of these polyols include, but are not limited to, 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, 1,3-diol, (namely, neopentyl glycol), 2,2,4-trimethyl-1,3-pentanediol, 2,2-diethylpropane-1,3-diol, 2,2-dibutylpropane-1,3-diol, 2-methyl-2-propylpropane-1,3-diol, trimethylolpropane (TMP), pentaerythritol, dipentaerythritol and the like and mixtures thereof.

The organic acids for use in forming the polyol esters can be those having from 4 to about 24 carbon atoms. Examples of organic acids include, but are not limited to, butanoic acid, isobutanoic acid, pentanoic acid, isopentanoic acid, hexanoic acid, 2-ethylbutanoic acid, cyclohexanoic acid, heptanoic acid, isoheptanoic acid, methylcyclohexanoic acid, octanoic acid, dimethyl-hexanoic acid, 2-ethylhexanoic acid, 2,4,4-trimethyl-pentanoic acid, isooctanoic acid, 3,5,5-trimethylhexanoic acid, nonanoic acid, isononanoic acid, isodecanoic acid, isoundecanoic acid, 2-butyloctanoic acid, tridecanoic acid, tetradecanoic acid, hexadecanoic acid, heptadecanoic acid, octadecanoic acid, 2-ethylhexadecanoic acid, nonadecanoic acid, 2-methyloctadecanoic acid, icosanoic acid, 2-methylicosanoic acid, 3-methylnonadecanoic acid, docosanoic acid, tetradocosanoic acid, 2-methyltricosanoic acid and the like and mixtures thereof.

The organic acids can also be fatty acids which are a class of compounds containing a long hydrocarbon chain and a terminal carboxylate group and are characterized as unsaturated or saturated depending upon whether a double bond is present in the hydrocarbon chain. Therefore, an unsaturated fatty acid has at least one double bond in its hydrocarbon chain whereas a saturated fatty acid has no double bonds in its fatty acid chain. Examples of unsaturated fatty acids include, but are not limited to, myristoleic acid, palmitoleic acid, oleic acid, linolenic acid and the like and mixtures thereof. Examples of saturated fatty acids include, but are not limited to, caproic acid, caprylic acid, capric acid, lauric acid, myristic acid, palmitic acid, stearic acid, arachidic acid, behenic acid, lignoceric acid and the like and mixtures thereof.

In another embodiment, the polyol ester is at least one glycerol ester such as a $C_4$ to about $C_{75}$ fatty acid glycerol ester and preferably a $C_6$ to about $C_{24}$ fatty acid glycerol ester. The glycerol esters for use herein can be glycerides derived from, for example, natural sources, i.e., those derived from natural sources such as plants or animals; synthetic oils and the like and mixtures thereof. Useful natural oil include, but are not limited to, coconut oil, babassu oil, palm kernel oil, palm oil, olive oil, castor oil, rape oil, corn oil, beef tallow oil, whale oil, sunflower, cottonseed oil, linseed oil, tung oil, tallow oil, lard oil, peanut oil, canola oil, soya oil, and the like and mixtures thereof. Useful synthetic oils include, but are not limited to, synthetic oils derived from the reaction of one or more carboxylic acids with one or more glycerols, e.g., glycerol triacetate, and the like and mixtures thereof. Suitable starting oils will ordinarily contain triacylglycerols (TAGs), which contain three fatty acid chains esterified to a glycerol moiety and can be natural or synthetic. For example, TAGs such as triolein, trieicosenoin, or trierucin can be used as starting materials. TAGs are commercially available, for example, from Sigma Chemical Company (St. Louis, Mo.), or can be synthesized using standard techniques.

The foregoing glycerol esters can contain from about $C_4$ to about $C_{75}$ and preferably contain about $C_6$ to about $C_{24}$ fatty acid esters, i.e., several fatty acid moieties, the number and type varying with the source of the oil. The fatty acid moieties independently can be unsaturated or saturated fatty acids. Examples of unsaturated fatty acids include, but are not limited to, myristoleic acid, palmitoleic acid, oleic acid, linolenic acid, and the like and mixtures thereof. Examples of saturated fatty acids include, but are not limited to, caproic acid, caprylic acid, capric acid, lauric acid, myristic acid, palmitic acid, stearic acid, arachidic acid, behenic acid, lignoceric acid, and the like and mixtures thereof.

The acid moiety may be supplied in a fully esterfied compound or one which is less than fully esterfied, e.g., glyceryl tri-stearate, glyceryl di-laurate and glyceryl mono-oleate, respectively. As one skilled in the art will readily appreciate, the starting material can be plant derived oils, i.e., vegetable oils. Suitable vegetable oils have a monounsaturated fatty acid content of at least about 50%, based on total fatty acid content, and include, for example, rapeseed (*Brassica*), sunflower (*Helianthus*), soybean (*Glycine max*), corn (*Zea mays*), *crambe* (*Crambe*), and meadowfoam (*Limnanthes*) oil. Canola oil, which has less than 2% erucic acid, is a particularly useful rapeseed oil. Oils having a monounsaturated fatty acid content of at least 70% are also particularly useful. The monounsaturated fatty acid content can be composed of, for example, oleic acid ($C_{18:1}$), eicosenoic acid ($C_{20:1}$), erucic acid ($C_{22:1}$), or mixtures thereof.

In one embodiment, the polyol esters can be glycerol esters of the general formula (I):

(I)

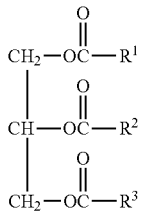

wherein $R^1$, $R^2$ and $R^3$ are independently aliphatic hydrocarbyl moieties having 4 to about 75 carbon atoms, preferably 4 to about 24 carbon atoms inclusive, and more preferably wherein at least one of $R^1$, $R^2$ and $R^3$ is a saturated aliphatic hydrocarbyl moiety having 4 to about 10 carbon atoms inclusive and wherein at least one of $R^1$, $R^2$ and $R^3$ is an aliphatic hydrocarbyl moiety having from 11 to about 24 carbon atoms inclusive.

In another embodiment, the polyol esters are compounds of the general formula (II):

(II)

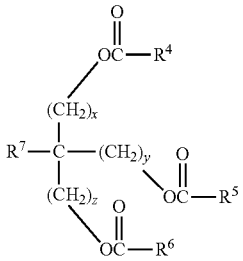

wherein $R^4$, $R^5$ and $R^6$ are independently aliphatic hydrocarbyl moieties having from 4 to about 24 carbon atoms, $R^7$ is hydrogen or an aliphatic hydrocarbyl moiety having 1 to 10 carbon atoms and x, y and z are the same or different and are integers from 1 to 10. The compounds of formula (II) are known compounds and can be prepared by known procedures and hence readily commercially available. Referring to the $R^4$, $R^5$ and $R^6$ groups, the aliphatic hydrocarbyl moieties may be independently saturated or unsaturated, linear (straight chain) or branched chain and preferably have 4 to about 24 carbon atoms, more preferably 4 to about 16 carbon atoms and most preferably 6 to about 10 carbon atoms. The $R^7$ group can be hydrogen or an aliphatic hydrocarbyl moiety such as, by way of example, a linear or branched chain alkyl group having from 1 to about 10 carbon atoms and preferably 1 to 6 carbon atoms, optionally containing an aromatic or aryl group. Examples of such polyol esters for use herein include, but are not limited to, trimethylolpropane (TMP) esters such as, for example, TMP tri(2-ethyl hexanoate), TMP triheptanoate, TMP tricaprylate, TMP tricaprate, TMP tri (isononanoate) and the like.

In one embodiment, an ester base stock for use in the trunk piston engine lubricating oil compositions of the present invention is an ester base stock having a kinematic viscosity of about 2 to about 10 cSt at 100° C. In another embodiment, an ester base stock for use in the trunk piston engine lubricating oil compositions of the present invention is an ester base stock having a kinematic viscosity of greater than about 10 to about 100 cSt at 100° C.

In one embodiment, an ester base stock for use in the trunk piston engine lubricating oil compositions of the present invention is Priolube® 3970, a polyol ester which is an ester of a neopentyl polyol, suitably trimethylolpropane, with at least one aliphatic, saturated monocarboxylic acid having 6 to 12 carbon atoms and having a kinematic viscosity at 100° C. of 4.4 cSt.

In another embodiment, the ester base stock will be present in the trunk piston engine lubricating oil compositions of the present invention in an amount of from about 20% by weight and no greater than about 40% by weight, based on the total weight of the trunk piston engine lubricating oil composition.

Alkylated aromatic base stocks for use in the trunk piston engine lubricating oil composition of the present invention can be monoalkylated aromatic base stocks, dialkylated aromatic base stocks, tri alkylated aromatic base stocks and the like. The alkylated aromatic base stocks are generally considered Group V base stocks. The alkylated moiety can be, for example, any linear or branched alkyl groups of about $C_6$ to $C_{30}$ alkyl, such as those derived from a $C_6$ to $C_{30}$ alpha olefin alkylating agent. Suitable aromatic group(s) can be of any molecular structure having aromatic character such as at least one six membered aromatic ring, optionally having any number of such six-membered rings fused together or connected by bonds or linking structures such as benzene rings, diphenyl rings. For example, the aromatic groups can have from 1 to about 10 such substituted or unsubstituted aromatic rings. If desired, when more than one cyclic containing group such as the aromatic groups are employed, the cyclic containing groups can be linked together with the same or different linking group, e.g., a $C_1$ to $C_{20}$ alkylene or haloalkylene group optionally containing ether or ester linkages. Suitable fused and/or polyfused aromatic groups include, but are not limited to, anthracene, phenanthrene, pyrene, indene, acenaphthylene, benzanthrene, chrysene, triphenylene, and naphthalene. In one preferred embodiment, the aromatic group is naphthalene.

The alkylated aromatic base stocks are either commercially available from such sources as King Industries under the KR Series, e.g., NA-LUBE® KR-007, and the like, or can be prepared by any method known in the art. See, for example, Synthetics, Mineral Oils, and Bio-Based Lubricants, Chemistry and Technology, Leslie R. Rudnick (editor), Taylor & Francis, 7, pp. 139-146 (2006), the contents of which are incorporated by reference herein. NA-LUBE® is a registered trademark of King Industries Specialty Chemicals. For example, alkylated aromatic base stocks such as alkylated naphthalenes can be produced from the alkylation of aromatics with an olefin, alcohol, alkylhalide, or other alkylating agents known to those of skill in the art in the presence of a catalyst. Suitable catalysts include any of Lewis acid or super acid catalysts known in the art. Suitable Lewis acids include boron trifluoride, iron trichloride, tin tetrachloride, zinc dichloride, and antimony pentafluoride. Acidic clays, silica, or alumina are also suitable. See, for example, U.S. Pat. Nos. 4,604,491 and 4,764,794. Suitable super acid catalysts include trifluoromethane sulfonic acid, hydrofluoric acid or trifluoromethylbenzene sulfonic acid. Other suitable catalysts include acidic zeolite catalysts, such as Zeolite Beta, Zeolite Y, ZSM-5, ZSM-35, and USY.

In one embodiment, the alkylated aromatic base stock will be present in the trunk piston engine lubricating oil compositions of the present invention in an amount of from about 1% by weight to about 45% by weight, based on the total weight of the trunk piston engine lubricating oil composition. In another embodiment, the alkylated aromatic base stock will be present in the trunk piston engine lubricating oil compositions of the present invention in an amount of from about 5% by weight to about 40% by weight, based on the total weight of the lubricating oil composition. In another embodiment, the alkylated aromatic base stock will be present in the trunk piston engine lubricating oil compositions of the present invention in an amount of from about 25% by weight to about 35% by weight, based on the total weight of the lubricating oil composition.

The base stock having an aromatic content of at least about 50% by weight is known in the art and includes those highly aromatic base stocks which are recovered from the refining of petroleum-derived feedstocks, such as by fluid catalytic cracking (FCC and the related TCC process), coking, pyrolysis, and the like. These base stocks are generally considered Group V base stocks. In one embodiment, a base stock having an aromatic content of at least about 50% by weight for use in preparing the trunk piston engine lubricating oil compositions of the present invention is one or more of FCC light cycle oils, FCC medium cycle oils, FCC heavy cycle oils and mixtures thereof, which are derived from a catalytic cracking refinery operation such as fluidized catalytic cracking refinery operations. A "light cycle oil" refers to hydrocarbons having a boiling range distribution between about 302° F. (150° C.) and about 752° F. (400° C.) that are produced from a fluidized catalytic cracking system. Light cycle oil content is determined by ASTM Method D5307. A "medium cycle oil" refers to hydrocarbons having a boiling range distribution between about 270° F. (132° C.) and about 900° F. (482° C.) that are produced from fluidized catalytic cracking system. Heavy cycle oil content is determined by ASTM Method D5307. A "heavy cycle oil" refers to hydrocarbons having a boiling range distribution between about 320° F. (160° C.) and about 1112° F. (600° C.) that are produced from fluidized catalytic cracking system. Heavy cycle oil content is determined by ASTM Method D5307.

In general, a FCC medium cycle oil can be a mixture of mono-, di and polyaromatics, e.g., a mixture of from about 5% by weight to about 15% by weight monoaromatics, from about 35% by weight to about 50% by weight diaromatics and from about 20% by weight to about 35% by weight polyaromatics. Examples of a FCC medium cycle oil for use herein include a normal FCC medium cycle oil, heavy FCC medium cycle oil and the like and mixtures thereof.

In one embodiment, the base stock having an aromatic content of at least about 50% by weight will be base stock having an aromatic content of at least about 60 percent by weight of aromatics.

In one embodiment, the base stock having an aromatic content of at least about 50% by weight will be present in the trunk piston engine lubricating oil compositions of the present invention in an amount of from about 1% by weight to about 45% by weight, based on the total weight of the lubricating oil composition. In another embodiment, the base stock having an aromatic content of at least about 50% by weight will be present in the trunk piston engine lubricating oil compositions of the present invention in an amount of from about 5% by weight to about 40% by weight, based on the total weight of the lubricating oil composition. In another embodiment, the base stock having an aromatic content of at least about 50% by weight will be present in the trunk piston engine lubricating oil compositions of the present invention in an amount of from about 25% by weight to about 35% by weight, based on the total weight of the trunk piston engine lubricating oil composition.

The base stock having an aromatic content of at least about 50% by weight is not an aromatic extract. In general, an aromatic extract is an extract that can be made by the treatment of at least one refinery process stream in a solvent extraction process. Solvent extraction processes include contacting the at least one refinery process stream with a solvent such as furfural, n-methylpyrrolidone, sulphur dioxide, Duo-Sol™ or phenol to selectively extract from the refinery stream, aromatic heterocyclic materials and to form a solution of these materials in the solvent. The solvent is then recovered from the solution for recycle to the extraction process; the resultant product being the aromatic extract.

The manufacture of aromatic extracts is known in the art and is described, for example, in "*Lubricant base oil and wax processing*" A. Sequeira, pages 81-118, pub. Marcel Dekker Inc. New York, 1994.

The aromatic extract may be a residual aromatic extract, which may be made by treatment in an extraction process, of solvent deasphalted vacuum residue (also known as DAO) made using Duo-Sol™, propane, butane or mixtures thereof as the solvent for the deasphalting.

The aromatic extract may be a distillate aromatic extract (DAE) which is an aromatic extract made by treatment in an extraction process, of a distillate stream from a vacuum distillation process. The distillate aromatic extract can be a treated distillate aromatic extract which is a distillate aromatic extract which has been subjected to at least one further treatment, e.g., hydrotreatment, hydrogenation, hydrodesulphurization, clay treatment, acid treatment and further solvent extraction.

The aromatic extract may have an aromatics content of 60 to 85 weight %, which may be measured by ASTM D 2007.

The distillate aromatic extract may have a boiling point in the range 250 to 680° C., which may be measured according to ASTM D2887. The distillate aromatic extract may have a kinematic viscosity at 40° C. in the range 5 to 18000 $mm^2/s$, which may be measured according to ASTM D 445. The distillate aromatic extract may have a kinematic viscosity at 100° C. in the range 3 to 60 $mm^2/s$, which may be measured according to ASTM D 445. The distillate aromatic extract may have an average molecular mass in the range 300 to 580, which may be measured according to ASTM D 2887. The distillate aromatic extract may have a carbon number range in the range $C_{15}$ to $C_{54}$, which may be measured according to ASTM D2887. The distillate aromatic extract may have an aromatic content in the range 65 to 85 weight %, which may be measured according to ASTM D 2007.

The residual aromatic extract may have a boiling point of greater than 380° C., which may be measured according to ASTM D 2887. The residual aromatic extract may have a kinematic viscosity at 40° C. of great than 4000 $mm^2/s$, which may be measured according to ASTM D 445. The residual aromatic extract may have a kinematic viscosity at 100° C. in the range 60-330 $mm^2/s$, which may be measured according to ASTM D 445. The residual aromatic extract may have an average molecular mass of greater than 400, which may be measured according to ASTM D 2887. The residual aromatic extract may have a carbon number range of greater than $C_{25}$, which may be measured according to ASTM D 2887. The residual aromatic extract may have an aromatic content in the range 60 to 85 weight %, which may be measured according to ASTM D 2007.

The trunk piston engine lubricating oil compositions of the present invention can have any total base number (TBN) that is suitable for use in trunk piston engines. The term "total base number" or "TBN" refers to the amount of base equivalent to milligrams of KOH in 1 gram of sample. Thus, higher TBN numbers reflect more alkaline products and therefore a greater alkalinity reserve. The TBN of the trunk piston engine lubricating oil compositions can be measured by any suitable method, such as by ASTM D2896. In general, the trunk piston engine lubricating oil compositions can have a TBN of at least about 12. In one embodiment, the trunk piston engine lubricating oil compositions can have a TBN of from about 20 to about 60. In another embodiment, the trunk piston engine lubricating oil compositions can have a TBN of from about 30 to about 50.

The trunk piston engine lubricating oil compositions of the present invention can have any viscosity that is suitable for use in a trunk piston engine. Generally, the trunk piston engine lubricating oil composition can have a viscosity ranging from about 5 to about 25 centistokes (cSt) at 100° C. and preferably from about 10 to about 20 cSt at 100° C. The viscosity of the trunk piston engine lubricating oil composition can be measured by any suitable method, e.g., ASTM D2270.

The trunk piston engine lubricating oil compositions of the present invention can be prepared by any method known to a person of ordinary skill in the art for making trunk piston engine lubricating oils. The ingredients can be added in any order and in any manner. Any suitable mixing or dispersing equipment may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., a Gaulin homogenizer or Rannie homogenizer), a mill (e.g., colloid mill, ball mill or sand mill) or any other mixing or dispersing equipment known in the art.

In one embodiment, the trunk piston engine lubricating oil compositions of the present invention are substantially free of a Group I base oil. The term "substantially free" as used herein shall be understood to mean relatively little to no amount of any Group I base oil, e.g., an amount less than about 5% by weight, preferably less than 1% by weight, and most preferably less than about 0.1% by weight, based on the total weight of the trunk piston engine lubricating oil composition. The term "Group I base oil" as used herein refers to a petroleum derived lubricating base oil having a saturates content of less than 90 wt. % (as determined by ASTM D 2007) and/or a total sulfur content of greater than 300 ppm (as determined by ASTM D 2622, ASTM D 4294, ASTM D 4297 or ASTM D 3120) and has a viscosity index (VI) of greater than or equal to 80 and less than 120 (as determined by ASTM D 2270).

The trunk piston engine lubricating oil compositions of the present invention may also contain conventional trunk piston engine lubricating oil composition additives for imparting auxiliary functions to give a finished trunk piston engine lubricating oil composition in which these additives are dispersed or dissolved. For example, the trunk piston engine lubricating oil compositions can be blended with antioxidants, ashless dispersants, anti-wear agents, detergents such as metal detergents, rust inhibitors, dehazing agents, demulsifying agents, metal deactivating agents, friction modifiers, pour point depressants, antifoaming agents, co-solvents, package compatibilisers, corrosion-inhibitors, dyes, extreme pressure agents and the like and mixtures thereof. A variety of the additives are known and commercially available. These additives, or their analogous compounds, can be employed for the preparation of the trunk piston engine lubricating oil compositions of the invention by the usual blending procedures.

Representative examples of antioxidants include, but are not limited to, aminic types, e.g., diphenylamine, phenyl-alpha-napthyl-amine, N,N-di(alkylphenyl)amines; and alkylated phenylene-diamines; phenolics such as, for example, BHT, sterically hindered alkyl phenols such as 2,6-di-tert-butylphenol, 2,6-di-tert-butyl-p-cresol and 2,6-di-tert-butyl-4-(2-octyl-3-propanoic) phenol; and mixtures thereof.

Representative examples of ashless dispersants include, but are not limited to, amines, alcohols, amides, or ester polar moieties attached to the polymer backbones via bridging groups. An ashless dispersant of the present invention may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters.

Succinimide dispersants are a type of carboxylic dispersant. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures. One class of succinic-based dispersants may be represented by the formula:

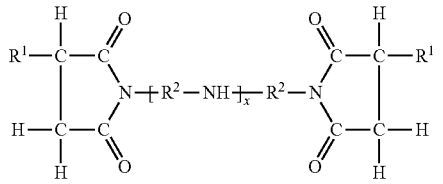

wherein each $R^1$ is independently a hydrocarbyl group, such as a polyolefin-derived group. Typically the hydrocarbyl group is an alkyl group, such as a polyisobutyl group. Alternatively expressed, the $R^1$ groups can contain about 40 to about 500 carbon atoms, and these atoms may be present in aliphatic forms. $R^2$ is an alkylene group, commonly an ethylene ($C_2H_4$) group. Examples of succinimide dispersants include those described in, for example, U.S. Pat. Nos. 3,172,892, 4,234,435 and 6,165,235.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

Succinimide dispersants are referred to as such since they normally contain nitrogen largely in the form of imide functionality, although the amide functionality may be in the form of amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, which typically falls between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

Suitable ashless dispersants may also include amine dispersants, which are reaction products of relatively high molecular weight aliphatic halides and amines, preferably polyalkylene polyamines. Examples of such amine dispersants include those described in, for example, U.S. Pat. Nos. 3,275,554, 3,438,757, 3,454,555 and 3,565,804.

Suitable ashless dispersants may further include "Mannich dispersants," which are reaction products of alkyl phenols in which the alkyl group contains at least about 30 carbon atoms with aldehydes (especially formaldehyde) and amines (especially polyalkylene polyamines). Examples of such dispersants include those described in, for example, U.S. Pat. Nos. 3,036,003, 3,586,629. 3,591,598 and 3,980,569.

Suitable ashless dispersants may also be post-treated ashless dispersants such as post-treated succinimides, e.g., post-treatment processes involving borate or ethylene carbonate as disclosed in, for example, U.S. Pat. Nos. 4,612,132 and 4,746,446; and the like as well as other post-treatment processes. The carbonate-treated alkenyl succinimide is a polybutene succinimide derived from polybutenes having a molecular weight of about 450 to about 3000, preferably from about 900 to about 2500, more preferably from about 1300 to about 2400, and most preferably from about 2000 to about 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as disclosed in U.S. Pat. No. 5,716,912, the contents of which are incorporated by reference herein.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730.

In one preferred embodiment of the present invention, an ashless dispersant for use in the lubricating oil composition is a bis-succinimide derived from a polyisobutenyl group having a number average molecular weight of about 700 to about 2300. The dispersant(s) for use in the lubricating oil compositions of the present invention are preferably non-polymeric (e g., are mono- or bis-succinimides).

Generally, the one or more ashless dispersants are present in the lubricating oil composition in an amount ranging from about 0.01% by weight to about 10% by weight, based on the total weight of the lubricating oil composition.

Representative examples of antiwear agents include, but are not limited to, zinc dialkyldithiophosphates and zinc diaryldithiophosphates, e.g., those described in an article by Born et al. entitled "Relationship between Chemical Structure and Effectiveness of Some Metallic Dialkyl- and Diaryldithiophosphates in Different Lubricated Mechanisms", appearing in Lubrication Science 4-2 January 1992, see for example pages 97-100; aryl phosphates and phosphites, sulfur-containing esters, phosphosulfur compounds, metal or ash-free dithiocarbamates, xanthates, alkyl sulfides and the like and mixtures thereof.

Representative examples of metal detergents include sulphonates, alkylphenates, sulfurized alkyl phenates, carboxylates, salicylates, phosphonates, and phosphinates. Commercial products are generally referred to as neutral or overbased. Overbased metal detergents are generally produced by carbonating a mixture of hydrocarbons, detergent acid, for example: sulfonic acid, alkylphenol, carboxylate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or $Ca(OH)_2$, to form the sulfonate.

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and would typically have a total base number or TBN (as can be measured by ASTM D2896) of from 0 to about 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g., carbonate) micelle. Such overbased detergents may have a TBN of about 150 or greater, and typically will have a TBN of from about 250 to about 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from about 20 to about 450, neutral and overbased calcium phenates and sulfurized phenates having TBN of from about 50 to about 450 and neutral and overbased magnesium or calcium salicylates having a TBN of from about 20 to about 450. Mixtures of detergents, whether overbased or neutral or both, may be used.

In one embodiment, the detergent can be one or more alkali or alkaline earth metal salts of an alkyl-substituted hydroxyaromatic carboxylic acid. Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like. The preferred hydroxyaromatic compound is phenol.

The alkyl substituted moiety of the alkali or alkaline earth metal salt of an alkyl-substituted hydroxyaromatic carboxylic acid is derived from an alpha olefin having from about 10 to about 80 carbon atoms. The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing.

In one embodiment, the mixture of linear olefins that may be used is a mixture of normal alpha olefins selected from olefins having from about 12 to about 30 carbon atoms per molecule. In one embodiment, the normal alpha olefins are isomerized using at least one of a solid or liquid catalyst.

In another embodiment, the olefins are a branched olefinic propylene oligomer or mixture thereof having from about 20 to about 80 carbon atoms, i.e., branched chain olefins derived from the polymerization of propylene. The olefins may also be substituted with other functional groups, such as hydroxy groups, carboxylic acid groups, heteroatoms, and the like. In one embodiment, the branched olefinic propylene oligomer or mixtures thereof have from about 20 to about 60 carbon atoms. In one embodiment, the branched olefinic propylene oligomer or mixtures thereof have from about 20 to about 40 carbon atoms.

In one embodiment, at least about 75 mole % (e.g., at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkaline earth metal salt of an alkyl-substituted hydroxybenzoic acid detergent are a $C_{20}$ or higher. In another embodiment, the alkali or alkaline earth metal salt of an alkyl-substituted hydroxyaromatic carboxylic acid is an alkali or alkaline earth metal salt of an alkyl-substituted hydroxybenzoic acid that is derived from an alkyl-substituted hydroxybenzoic acid in which the alkyl groups are the residue of normal alpha-olefins containing at least 75 mole % $C_{20}$ or higher normal alpha-olefins.

In another embodiment, at least about 50 mole % (e.g., at least about 60 mole %, at least about 70 mole %, at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkali or alkaline earth metal salt of an alkyl-substituted hydroxybenzoic acid are about $C_{14}$ to about $C_{18}$.

The resulting alkali or alkaline earth metal salt of an alkyl-substituted hydroxyaromatic carboxylic acid will be a mixture of ortho and para isomers. In one embodiment, the product will contain about 1 to 99% ortho isomer and 99 to 1% para isomer. In another embodiment, the product will contain about 5 to 70% ortho and 95 to 30% para isomer.

The alkali or alkaline earth metal salts of an alkyl-substituted hydroxyaromatic carboxylic acid can be neutral or overbased. Generally, an overbased alkali or alkaline earth metal salt of an alkyl-substituted hydroxyaromatic carboxylic acid is one in which the BN of the alkali or alkaline earth metal salts of an alkyl-substituted hydroxyaromatic carboxylic acid has been increased by a process such as the addition of a base source (e.g., lime) and an acidic overbasing compound (e.g., carbon dioxide).

Overbased salts may be low overbased, e.g., an overbased salt having a BN below about 100. In one embodiment, the BN of a low overbased salt may be from about 5 to about 50. In another embodiment, the BN of a low overbased salt may be from about 10 to about 30. In yet another embodiment, the BN of a low overbased salt may be from about 15 to about 20.

Overbased detergents may be medium overbased, e.g., an overbased salt having a BN from about 100 to about 250. In one embodiment, the BN of a medium overbased salt may be from about 100 to about 200. In another embodiment, the BN of a medium overbased salt may be from about 125 to about 175.

Overbased detergents may be high overbased, e.g., an overbased salt having a BN above about 250. In one embodiment, the BN of a high overbased salt may be from about 250 to about 450.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to about 220 wt. % (preferably at least about 125 wt. %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Generally, the detergents can be present in the trunk piston engine lubricating oil compositions in amount of about 1% by weight to about 15% by weight, based on the total weight of the trunk piston engine lubricating oil composition.

Representative examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Representative examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof.

Representative examples of antifoaming agents include, but are not limited to, polymers of alkyl methacrylate; polymers of dimethylsilicone and the like and mixtures thereof.

Representative examples of a pour point depressant include, but are not limited to, polymethacrylates, alkyl acrylate polymers, alkyl methacrylate polymers, di(tetra-paraffin phenol)phthalate, condensates of tetra-paraffin phenol, condensates of a chlorinated paraffin with naphthalene and mixtures thereof. In one embodiment, a pour point depressant comprises an ethylene-vinyl acetate copolymer, a condensate of chlorinated paraffin and phenol, polyalkyl styrene and the like and mixtures thereof. The amount of the pour point depressant may vary from about 0.01% by weight to about 10% by weight.

Representative examples of a demulsifier include, but are not limited to, anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and the like and mixtures thereof. The amount of the demulsifier may vary from about 0.01% by weight to about 10% by weight.

Representative examples of a corrosion inhibitor include, but are not limited to, half esters or amides of dodecylsuccinic acid, phosphate esters, thiophosphates, alkyl imidazolines, sarcosines and the like and mixtures thereof. The amount of the corrosion inhibitor may vary from about 0.01% by weight to about 5% by weight.

Representative examples of an extreme pressure agent include, but are not limited to, sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and mixtures thereof. The amount of the extreme pressure agent may vary from about 0.01% by weight to about 5% by weight.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, may range, unless otherwise specified, from about 0.001% to about 20% by weight, and in one embodiment about 0.01% to about 10% by weight based on the total weight of the lubricating oil composition.

If desired, the trunk piston engine lubricating oil additives may be provided as an additive package or concentrate in which the additives are incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will typically contain one or more of the various additives, referred to above, in the desired amounts and ratios to facilitate direct combination with the requisite amount of the (a) major amount of a base stock containing at least 90% by weight saturated hydrocarbons; and (b) minor amount of a base stock selected from the group consisting of (i) an ester base stock wherein the ester base stock is present in an amount greater than about 10% by weight based on the total weight of the lubricating oil composition, (ii) an alkyl aromatic base stock, and (iii) a base stock having an aromatic content of at least 50% by weight wherein the base stock having an aromatic content of at least 50% by weight is not an aromatic extract.

The trunk piston engine lubricating oil compositions of the present invention may be suitable for use in a 4-stroke trunk piston engine having an engine speed of about 200 to about 2,000 rotations per minute (rpm), e.g., about 400 to about 1,000 rpm, and a brake horse-power (BHP) per cylinder of about 50 to about 5,000, preferably about 100 to about 3,000 and most preferably from about 100 to about 2,000. Engines used for auxiliary power generation applications or in land-based power generation applications are also suitable.

The following non-limiting examples are illustrative of the present invention.

Examples 1-5 and Comparative Examples A-C

Trunk piston engine lubricating oil compositions were prepared as set forth below in Table 1. Each trunk piston engine lubricating oil composition was an SAE 40 viscosity grade with a TBN of 40 mg KOH/g. The trunk piston engine lubricating oil compositions of Examples 1-5 (within the scope of the invention) were formulated with the combination of a Group II base oil and either (i) 30% by weight of ester base oil (ii) an alkyl aromatic base oil or (iii) a base oil having an aromatic content of at least 50% by weight, whereas the trunk piston engine lubricating oil compositions of Comparative Examples A-C (outside the scope of the invention) were formulated as follows: a Group I base oil alone (Comparative Example A), a Group II base oil alone (Comparative Example B) and the combination of a Group II base oil and 10% by weight of an ester base oil (Comparative Example C).

The trunk piston engine lubricating oil compositions of Examples 1-5 and Comparative Examples A-C were tested for the amount of black sludge formation in the Black Sludge Deposit (BSD) Test. In the BSD Test, a sample of test oil was mixed with 7.5 wt. % heavy fuel oil to form a test mixture. Each test mixture was pumped over a heated test plate for a specified period of time. After cooling and washing, test plates were dried and weighed. The weight of each steel test plate was determined, and the weight of the deposit remaining on the steel test plate was measured and recorded as the change in weight of the steel test plate. The results of the BSD test are set forth below in Table 1.

TABLE 1

| Formulations | Comp. Ex. A (wt. %) | Comp. Ex. B (wt. %) | Comp. Ex. C (wt. %) | Ex. 1 (wt. %) | Ex. 2 (wt. %) | Ex. 3 (wt. %) | Ex. 4 (wt. %) | Ex. 5 (wt. %) |
|---|---|---|---|---|---|---|---|---|
| Additives: | | | | | | | | |
| 350 TBN Ca alkylhydroxy benzoate | 9.81 | 9.81 | 9.81 | 9.81 | 9.81 | 9.81 | 9.81 | 9.81 |
| 150 TBN Ca alkylhydroxy benzoate | 2.94 | 2.94 | 2.94 | 2.94 | 2.94 | 2.94 | 2.94 | 2.94 |
| ZnDTP | 0.68 | 0.68 | 0.68 | 0.68 | 0.68 | 0.68 | 0.68 | 0.68 |
| Foam inhibitor | 0.04 | 0.04 | 0.04 | 0.04 | 0.04 | 0.04 | 0.04 | 0.04 |
| Group I base oil | 86.53 | — | — | — | — | — | — | — |
| Group II base oil | — | 86.53 | 76.53 | 56.53 | 76.53 | 56.53 | 76.53 | 56.53 |
| Ester base oil[1] | — | — | 10.00 | 30.00 | — | — | — | — |
| Alkylated aromatic base oil[2] | — | — | — | — | 10.00 | 30.00 | — | — |
| FCC medium cycle oil[3] | — | — | — | — | — | — | 10.00 | 30.00 |
| BSD Results: | | | | | | | | |
| 200° C./12 hr (mg) | 14 | 46 | 43 | 20 | 20 | 15 | | |
| 170° C./12 hr (mg) | 2 | 21 | | | | | 7 | 2 |

[1]A polyol ester available from Croda Lubricants as PRIOLUBE ® 3970.
[2]An alkylated naphthalene available from King Industries as NA-LUBE ® KR-007.
[3]A highly aromatic refinery stream derived by fluid catalytic cracking (aromatic content = 62%).

As the data show, the trunk piston engine lubricating oil compositions containing the combination of a Group II base stock and 30% by weight of an ester base oil (Example 1) or an alkylated aromatic base stock (Examples 2 and 3) or a base stock having an aromatic content of at least 50% by weight (Examples 4 and 5) exhibited less black sludge deposit formation than the trunk piston engine lubricating oil composition containing a Group II base stock alone (Comparative Example B) and exhibited comparable black sludge deposit formation to a trunk piston engine lubricating oil composition containing a Group I base stock alone (Comparative Example A). The trunk piston lubricating oil compositions containing only a Group II base stock (Comparative Example B) and the combination of a Group II base stock and 10% by weight of an ester base stock (Comparative Example C) demonstrated significant black sludge deposit formation as compared to the trunk piston engine lubricating oil compositions of Examples 1-5.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A trunk piston engine lubricating oil composition comprising (a) a major amount of a base stock containing at least 90% by weight saturated hydrocarbons; and (b) a base stock selected from the group consisting of (i) an ester base stock wherein the ester base stock is present in an amount greater than 10% by weight and no greater than about 45% by weight, based on the total weight of the lubricating oil composition, (ii) an alkylated aromatic base stock, (iii) a base stock having an aromatic content of at least about 50% by weight wherein the base stock having an aromatic content of at least about 50% by weight is not an aromatic extract, and mixtures thereof; wherein the base stock (b) is a base stock having an aromatic content of at least about 50% by weight and is a medium cycle oil from a fluid catalytic cracking unit.

2. The trunk piston engine lubricating oil composition of claim 1, wherein the base stock comprising at least 90% by weight saturated hydrocarbons comprises at least one of a Group II base stock, a Group III base stock or a base stock derived from a Fischer-Tropsch synthesized, waxy, paraffinic hydrocarbon material.

3. The trunk piston engine lubricating oil composition of claim 1, wherein the base stock comprising at least 90% by weight saturated hydrocarbons comprises at least one Group II base stock.

4. The trunk piston engine lubricating oil composition of claim 1, which is substantially free of a Group I base stock.

5. The trunk piston engine lubricating oil composition of claim 1, further comprising one or more trunk piston engine lubricating oil composition additives selected from the group consisting of an antioxidant, anti-wear agent, detergent, rust inhibitor, dehazing agent, demulsifying agent, metal deactivating agent, friction modifier, pour point depressant, anti-foaming agent, co-solvent, package compatibiliser, corrosion-inhibitor, ashless dispersant, dye, extreme pressure agent and mixtures thereof.

6. A method for improving heavy fuel oil compatibility of a trunk piston engine lubricating oil composition comprising a major amount of a base stock containing at least 90% by weight saturated hydrocarbons, the method comprising adding to the trunk piston engine oil composition a base stock having an aromatic content of at least about 50% by weight and which is a medium cycle oil from a fluid catalytic cracking unit.

7. The method of claim 6, wherein the base stock comprising at least 90% by weight saturated hydrocarbons comprises at least one of a Group II base stock, a Group III base stock or a base stock derived from a Fischer-Tropsch synthesized, waxy, paraffinic hydrocarbon material.

8. The method of claim 6, wherein the base stock comprising at least 90% by weight saturated hydrocarbons comprises at least one Group II base stock.

9. A method for operating a trunk piston engine, the method comprising lubricating the trunk piston engine with a trunk piston engine lubricating oil comprising (a) a major amount of a base stock containing at least 90% by weight saturated hydrocarbons; and (b) a base stock having an aromatic content of at least about 50% by weight and which is a medium cycle oil from a fluid catalytic cracking unit.

10. A method for operating a trunk piston engine, the method comprising lubricating the trunk piston engine with a trunk piston engine lubricating oil composition comprising (a) a major amount of a base stock containing at least 90% by weight saturated hydrocarbons; and (b) a base stock selected from the group consisting of (i) an ester base stock wherein the ester base stock is present in an amount greater than 10% by weight and no greater than about 45% by weight, based on the total weight of the lubricating oil composition, (ii) an alkylated aromatic base stock, (iii) a base stock having an aromatic content of at least about 50% by weight wherein the base stock having an aromatic content of at least about 50% by weight is not an aromatic extract, and mixtures thereof;

wherein the base stock (b) is a base stock having an aromatic content of at least about 50% by weight and is a medium cycle oil from a fluid catalytic cracking unit.

* * * * *